United States Patent [19]

Huang et al.

[11] Patent Number: 4,725,322

[45] Date of Patent: Feb. 16, 1988

[54] CARBON CONTAINING BORON DOPED TRI-NICKEL ALUMINIDE

[75] Inventors: Shyh-Chin Huang, Latham; Keh-Minn Chang; Alan I. Taub, both of Schenectady, all of N.Y.

[73] Assignee: General Electric Company, Schenectady, N.Y.

[21] Appl. No.: 783,513

[22] Filed: Oct. 3, 1985

[51] Int. Cl.[4] ..... C22C 19/03

[52] U.S. Cl. ..... 148/429; 420/460

[58] Field of Search ..... 148/429, 4; 420/460

[56] References Cited

PUBLICATIONS

C. T. Liu & C. C. Koch, "Development of Ductile Polycrystalline $Ni_3Al$ For High-Temperature Applications", Technical Aspects of Critical Materials Use by the Steel Industry, NBSIR 83-2679-2, vol. IIB (Jun. 1983) Center for Materials Science, U.S. Dept. of Commerce, Nat'l. Bureau of Standards.

*Primary Examiner*—R. Dean

*Attorney, Agent, or Firm*—Paul E. Rochford; James C. Davis, Jr.; Paul R. Webb, II

[57] ABSTRACT

A tri-nickel aluminide base alloy composition is provided with a desirable combination of tensile strength and ductility. The composition is prepared to include boron dopant in combination with relatively low percentages of carbon for the high increase in strength achieved. The composition has an $Ll_2$ of crystalline structure. It is prepared by rapid solidification at a cooling rate of at least $10^{3°}$ C. per second.

9 Claims, No Drawings

CARBON CONTAINING BORON DOPED TRI-NICKEL ALUMINIDE

BACKGROUND OF THE INVENTION

The present invention relates generally to tri-nickel aluminide materials of substantial strength and ductility. More specifically, it relates to compositions having a tri-nickel aluminide base and having substituents which impart to the base material a desirable combination of properties for use in structural applications.

It is known that polycrystalline tri-nickel aluminide castings exhibit properties of extreme brittleness, low strength and poor ductility at room temperature.

The single crystal tri-nickel aluminide in certain orientations does display a favorable combination of properties at room temperature including significant ductility. However, the polycrystalline material which is conventionally formed by known processes does not display the desirable properties of the single crystal material and, although potentially useful as a high temperature structural material, has not found extensive use in this application because of the poor properties of the material at room temperature.

It is known that tri-nickel aluminide has good physical properties at temperatures above 1000° F. and could be employed, for example, in jet engines as component parts at operating or higher temperatures. However, if the material does not have favorable properties at room temperature and below the part formed of the aluminide may break when subjected to stress at the lower temperatures at which the part would be maintained prior to starting the engine and prior to operating the engine at the higher temperatures.

Alloys having a tri-nickel aluminide base are among the group of alloys known as heat-resisting alloys or superalloys. These alloys are intended for very high temperature service where relatively high stresses such as tensile, thermal, vibratory and shock stresses are encountered and where oxidation resistance is frequently required.

Accordingly, what has been sought in the field of superalloys is an alloy composition which displays favorable stress resistant properties not only at the elevated temperatures at which it may be used, as for example in a jet engine, but also a practical and desirable and useful set of properties at the lower temperatures to which the engine is subjected in storage and mounting and starting operations. For example, it is well known that an engine may be subjected to severe subfreezing temperatures while standing on an airfield or runway prior to starting the engine.

Significant efforts have been made toward producing a tri-nickel aluminide and similar superalloys which may be useful over such a wide range of temperature and adapted to withstand the stress to which the articles made from the material may be subjected in normal operations over such a wide range of temperatures.

For example, U.S. Pat. No. 4,478,791, assigned to the same assignee as the subject application, teaches a method by which a significant measure of ductility can be imparted to a tri-nickel aluminide base metal at room temperature to overcome the brittleness of this material.

Also, copending applications of the same inventors as the subject application, Ser. Nos. 647,326; 647,327; 647,328; 646,877 and 646,879, filed Sept. 4, 1984 teach methods by which the composition and methods of the U.S. Pat. No. 4,478,791 may be further improved. These applications are incorporated herein by reference.

We have now discovered a beneficial effect of carbon on tri-nickel aluminides.

The effect of carbon in $Ni_3Al$ was previously studied by R. W. Guard and J. H. Westbrook (Trans. Met. Soc. AIME, Vol. 215, 1959, pp. 807–814). A hardness of ~200 kg/mm$^2$ was measured at room temperature for $Ni_3Al$ containing 0, 0.2 and 2.0 atomic percent carbon, showing little carbon effect on the mechanical behavior of $Ni_3Al$. The solubility of carbon in $Ni_3Al$ was determined to be 5.8 atomic percent (L. J. Huetter and H. H. Stadelmaier, Acta Met., Vol. 6, 1958, pp. 367–370). The solubility was extended to about 7.8 atomic percent by rapid solidification (K. H. Han and W. K. Choo, Scripta Met., Vol. 17, 1983, pp. 21–284). The above two papers did not deal with mechanical behavior.

Recently, iron base alloys in the Fe-Ni-Al-C system were investigated (A. Inoue, Y. Kojima, T. Minemura and T. Masumoto, Met. Trans. A, Vol. 12A, 1981, pp. 1245–1253). It was found that, by rapid solidification, nonequilibrium $Ll_2$ phase alloys could be produced in this iron-base system in the composition range of 7–55 weight percent Ni, 8–9 weight percent Al and 0.8–2.4 weight percent C, the balance being iron. This nonequilibrium phase was found to be ductile by tensile tests. The yield strength increased with carbon concentration, from ~900 MPa at 1.2 weight percent C to ~1700 MPa at 2.4 weight percent C, in a matrix of Fe-20Ni-8Al. However, tempering the material at a temperature as low as 500° C. for 1 hour resulted in the alloy becoming brittle due to phase decomposition. No further properties were reported for the embrittled material. The iron base material has no useful structural applications because of its tendency to return to an equilibrium condition and to acquire brittle properties over a period of time. High temperature use of the material accelerates its return to a brittle condition.

BRIEF SUMMARY OF THE INVENTION

It is accordingly one object of the present invention to provide a method of forming an article adapted to use in structural parts at room temperature as well as at elevated temperatures.

Another object is to provide an article suitable for withstanding significant degrees of stress and for providing appreciable ductility at room temperature as well as at elevated temperatures.

Other objects will be in part apparent and in part set forth in the description which follows.

In one of its broader aspects an object of the present invention may be achieved by providing a melt having a tri-nickel aluminide base and containing a relatively small percentage of boron and carbon. The melt is then rapidly solidified.

Although the melt referred to above should ideally consist only of the atoms of the intermetallic phase and atoms of carbon and boron, it is recognized that occasionally and inevitably other atoms of one or more incidental impurity atoms may be present in the melt.

As used herein the expression tri-nickel aluminide base composition refers to a tri-nickel aluminide which contains impurities which are conventionally found in nickel aluminide compositions. It includes as well other constituents and/or substituents which do not detract from the unique set of favorable properties which are achieved through practice of the present invention.

DETAILED DESCRIPTION OF THE INVENTION

In the description which follows, composition percentages are given in atomic percent unless otherwise specified.

In the case of the superalloy system $Ni_3Al$ or nickel base superalloy, the ingredient or constituent metals are nickel and aluminum. The metals are present in the stoichiometric atomic ratio of 3 nickel atoms for each aluminum atom in this system.

A nickel aluminide base metal of this invention may also have some substituent metals present such as are taught in the copending applications filed Sept. 4, 1984 and referenced above where their presence does not detract from the favorable set of properties achieved through the incorporation of carbon in the aluminide.

Nickel aluminide is found in the nickel-aluminum binary system and as the gamma prime phase of conventional gamma/gamma' nickel-base superalloys. Single crystal tri-nickel aluminide has high hardness and is stable and resistant to oxidation and corrosion at elevated temperatures which makes it attractive as a potential structural material.

Nickel aluminide, which has a face centered cubic (FCC) crystal structure of the $Cu_3Al$ type ($Ll_2$ in the Stukturbericht designation which is the designation used herein and in the appended claims) with a lattice parameter $a_o=3.589$ at 75 at %Ni and melts in the range of from about 1385° C. to 1395° C., is formed from aluminum and nickel which have melting points of 660° C. and 1453° C., respectively. Although frequently referred to as $Ni_3Al$, nickel aluminide is an intermetallic phase and not a compound as it exists over a range of compositions as a function of temperature, e.g., about 72.5 to 77 at %Ni (85.1 to 87.8 wt %) at 600° C.

Polycrystalline $Ni_3Al$ is quite brittle and shatters under stress as applied in efforts to form the material into useful objects or to use such an article.

It was discovered that the inclusion of boron in the rapidly cooled and solidified alloy system can impart desirable ductility to the rapidly solidified alloy as taught in U.S. Pat. No. 4,478,791.

The alloy compositions of the prior and also of the present invention must also contain boron as a tertiary ingredient as taught herein and as taught in U.S. Pat. No. 4,478,791.

A preferred range for the boron tertiary addition is between 0.25 and 1.75%.

By the prior teaching of U.S. Pat. No. 4,478,791, it was found that the optimum boron addition was in the range of 1 atomic percent and permitted a yield strength value at room temperature of about 100 ksi to be achieved for the rapidly solidified product. An upper reading of fracture strain of such a product was about 10% at room temperature.

The composition which is formed must have a preselected intermetallic phase having a crystal structure of the $Ll_2$ type and must have been formed by cooling a melt at a cooling rate of at least about $10^{3}$° C. per second to form a solid body the principal phase of which is of the $Ll_2$ type crystal structure in either its ordered or disordered state. The melt composition from which the structure is formed must have the first constituent and second constituent, including any respective substituents, present in the melt in an atomic ratio of approximately 3:1.

In the practice of this invention, an intermetallic phase having an $Ll_2$ type crystal structure is important. It is achieved in alloys of this invention as a result of rapid solidification. It is important that the $Ll_2$ type crystal structure be preserved in the products which are formed.

By use of the term rapid solidification as used herein is meant that the melt is rapidly cooled at a rate in excess of $10^{3}$° C./sec. to form solid bodies the principal phase of which is of the $Ll_2$ type crystal structure in either its ordered or disordered state. Thus, although the rapidly solidified solid bodies will principally have the same crystal structure as the preselected intermetallic phase, i.e., the $Ll_2$ type, the presence of other phases, e.g., borides, is possible. Since the cooling rates are high, it is also possible that the crystal structure of the rapidly solidified solid will be disordered, i.e., the atoms will be located at random sites on the crystal lattice instead of at specific periodic positions on the crystal lattice as is the case with ordered solid solutions.

The invention and the advantages made possible by the invention will be made clearer by reference to the following examples.

EXAMPLES 1–4

Four heats of compositions, corresponding to those listed in Table I below, were each in turn prepared, comminuted, and about 60 grams of the pieces of each sample in turn were delivered into an alumina crucible of a chill-block melt spinning apparatus. The crucible employed in each of the castings terminated in a flat-bottomed exit section having a slot 0.25 (6.35 mm) inches by 25 mils (0.635 mm) therethrough. Also, for each of the castings, a chill block, in the form of a wheel having faces 10 inches (25.4 cm) in diameter with a thickness (rim) of 1.5 inches (3.8), made of H-12 tool steel, was oriented vertically so that the rim surface could be used as the casting (chill) surface when the wheel was rotated about a horizontal axis passing through the centers of and perpendicular to the wheel faces. Further, for each of the castings, the crucible was placed in a vertically up orientation and brought to within about 1.2 to 1.6 mils (30–40$\mu$) of the casting surface with the 0.25 inch length dimension of the slot oriented perpendicular to the direction of rotation of the wheel.

As each sample was cast, the wheel was rotated at 1200 rpm, the melt was heated to between about 1350° C. and 1450° C. and ejected as a rectangular stream onto the rotating chill surface under the pressure of argon at about 1.5 psi to produce a long ribbon which measured from about 40–70$\mu$ in thickness by about 0.25 inches in width.

Four ribbon samples were produced, one for each of the four melts which were prepared and which were then cast as ribbon in the apparatus as described above.

The composition of each of the four melts of the four examples are listed in the accompanying Table I. Each contained a different carbon content.

Further, the ribbon produced from each melt was tested for ductility by a conventional bend ductility test.

This test involves bending the sample through 180°. A ribbon which can be bent through 180° without breaking is rated a 1.0. A ribbon which breaks before being bent through 180° is rated less than 1.0. A low value indicates a small angle of bending before breakage. The results of tests performed on four samples are given in Table I. It is evident from the low values found from the Bend Ductility tests that carbon addition alone did not improve the ductility of these samples.

TABLE I

Bend Ductility of Melt Spun $(Ni_{0.75}Al_{0.25})_{100-x}C_x$ at Room Temperature

| Example | Alloy Sample II | Carbon Content | Bend Ductility |
|---|---|---|---|
| 1 | 4 | x = 0 | 0.014 |
| 2 | 19 | x = 0.5 | 0.010 |
| 3 | 20 | x = 1.0 | 0.011 |
| 4 | 21 | x = 2.0 | 0.006 |

EXAMPLES 5-9

Five additional ribbon samples were prepared as described with respect to Examples 1-4. The composition of each of the five examples and properties measured are listed in Table II.

TABLE II

Mechanical Properties of $(Ni_{.76}Al_{.24})_{99.5-x}B_{0.5}C_x$

| Ex. | Alloy Sample # | Composition | Bend Ductility | Tensile Strain (%) | Yield Strength (ksi) |
|---|---|---|---|---|---|
| 5 | 191 | x = 0 | 1.0 | 27.0 | 90 |
| 6 | 325 | x = 0.25 | 1.0 | 10.5 | 108 |
| 7 | 316 | x = 0.5 | 1.0 | 20.6 | 114 |
| 8 | 327 | x = 1.0 | 1.0 | 11.4 | 141 |
| 9 | 317 | x = 1.5 | 1.0 | 3.8 | 168 |

It is evident from the data which is tabulated in Table II that each of the samples which contain 0.5% boron were fully ductile in the sense that they could be bent through a 180° angle and that accordingly they had a bend ductility value of 1.0. Ductility values above the 1.0 measure are not susceptible to test by the bend ductility test and thus the five samples cannot be distinguished as to ductility properties by the bend ductility test alone. However, the ductility is tested as a tensile strain measured in % and, as is evident from Table II, the tensile strain of the samples tested had a minimum ductility of 3.8%. As is evident from the table, the ductility varies relative to the concentration of the carbon present and a maximum ductility value of 20.0% tensile strain was measured for the sample of Example 7 which contained 0.5% carbon. The results obtained and presented here are consistent with the experimental data presented in the U.S. Pat. No. 4,478,791 assigned to the same assignee as the subject application.

Of particular interest is the change in yield strength with the change in concentration of carbon within the sample composition. Test results are listed for the sample of Example 5 which contain no carbon and also the ductility and yield strength data are listed for the four examples, 6, 7, 8 and 9, which did contain, respectively, the carbon concentrations of 0.25; 0.5; 1.0 and 1.5 for x as x is used in the expression in the heading of Table II. The yield strength values increased for each of the Examples 5, 6, 7, 8 and 9 and by evaluating the change in yield strength and relating it back to the change in concentration of carbon it can be determined from the data listed in Table II that there is a increase of about 50 ksi for each increase of 1 atomic percent of carbon. Optimum values of yield strength and tensile strain for particular application of the composition of the present invention can be determined from the values listed in Table II. The large increase in yield strength with increasing carbon concentration is offset and counterbalanced by the decrease in the tensile strain with the increase in carbon concentration. At concentrations above the 1.5 value in the expression provided at the top of Table II tensile strength ductility values may be too low to permit use of the compositions for many applications.

Where a maximum ductility is desired, a yield strength of 114 ksi is available for a sample having a ductility of 20.6%.

Where higher yield strengths are desired and lower tensile strains can be accepted, the higher concentrations of carbon of the order of 1 or 1.5% can be employed in compositions to permit high yield strengths to be coupled with lower but useful levels of tensile strain.

The concentration of boron is not limited to the concentration given in the above example. Other concentrations of boron which render the rapidly solidified tri-nickel aluminide ductile may be employed. The concentrations which are useful and preferred in practice of the present invention are similar to those pointed out in commonly assigned U.S. Pat. No. 4,478,791, the text of which is incorporated herein by reference. A range from 0.01 to 2.5 atomic percent is an operable range. A preferred range is from 0.1 to 1.5 atomic percent boron.

What is claimed and sought to be protected by Letters Patent of the United States is as follows:

1. A method of forming a tri-nickel aluminide of high strength and ductility which comprises providing a melt having a composition in atomic percent according to the following expression and parameters:

$$(Ni_{1.0-x}Al_x)_{99.5-z}B_{0.5}C_z$$

where x is between 0.23 and 0.245, and
where z is between 0.1 and 2.5,
rapidly solidifying the melt and
collecting the solidified product.

2. The method of claim 1 wherein z is between 0.25 and 2.0.

3. The method of claim 1 wherein the solidification is at a rate of at least 1000° C. per second.

4. The method of claim 1 in which the rapidly solidified composition is consolidated by heating and pressing.

5. A tri-nickel aluminide comprising a rapidly solidified composition having a $Ll_2$ type crystallography, said aluminide having a composition in atomic percent according to the following expression and parameters:

$$(Ni_{1.0-x}Al_x)_{99.5-z}B_{0.5}C_z$$

wherein x is between 0.23 and 0.245, and wherein z is between 0.1 and 2.5.

6. The aluminide of claim 5 wherein z is between 0.25 and 2.0.

7. The aluminide of claim 5 wherein z is 0.5 to 1.0.

8. A tri-nickel aluminide comprising a rapidly solidified composition having an $Ll_2$ type crystallography, said aluminide having a composition in atomic percent according to the following expression and parameters:

$$(Ni_{1-x}Al_x)_{100-x-z}B_yC_z$$

wherein x is between 0.23 and 0.245,
wherein y is between 0.1 and 2.0, and
wherein z is between 0.1 and 2.0.

9. The aluminide of claim 8 wherein y is about 0.25 to 1.0 and z is between 0.1 and 1.5.

* * * * *